US011640885B2

(12) United States Patent
Ramachandra et al.

(10) Patent No.: US 11,640,885 B2
(45) Date of Patent: May 2, 2023

(54) ROTARY SWITCH

(71) Applicant: HONEYWELL INTERNATIONAL INC., Charlotte, NC (US)

(72) Inventors: Sadyojatha Ramachandra, Charlotte, NC (US); Radhakrishnan Selvaraj, Charlotte, NC (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 160 days.

(21) Appl. No.: 17/150,259

(22) Filed: Jan. 15, 2021

(65) Prior Publication Data

US 2021/0225605 A1 Jul. 22, 2021

(30) Foreign Application Priority Data

Jan. 20, 2020 (IN) ..... 202011002501

(51) Int. Cl.
*H01H 19/58* (2006.01)
*H01H 19/08* (2006.01)

(52) U.S. Cl.
CPC ..... *H01H 19/08* (2013.01); *H01H 19/58* (2013.01); *H01H 2231/026* (2013.01); *H01H 2239/012* (2013.01)

(58) Field of Classification Search
CPC ..... H01H 19/14; H01H 19/11; H01H 19/585; H01H 19/58; H01H 19/62; H01H 19/635; H01H 19/64; H01H 19/63; H01H 19/005; H01H 19/10; H01H 1/2041; H01H 19/56; H01H 19/03; H01H 19/02; H01H 2019/006; H01H 19/00; H01H 19/20; H01H 19/001; H01H 21/50; H01H 2221/01
See application file for complete search history.

(56) References Cited

U.S. PATENT DOCUMENTS 5,010,214 A 4/1991 Yamazaki

FOREIGN PATENT DOCUMENTS

CN 203910383 * 10/2014
DE 102016218493 * 3/2018 ..... H01H 37/60

* cited by examiner

*Primary Examiner* — Ahmed M Saeed
(74) *Attorney, Agent, or Firm* — Alston & Bird LLP

(57) ABSTRACT

Apparatuses, systems, and methods of manufacturing are described that provide a rotary switch. An example rotary switch includes a substrate and a plurality of electrical contacts supported by the substrate. The rotary switch includes a resistor network of a plurality of resistors in electrical communication with the plurality of electrical contacts and a commutator that moves relative to the substrate along the plurality of electrical contacts. The commutator electrically connects a pair of adjacent electrical contacts so as to modify an output voltage of the rotary switch corresponding to a position of the rotary switch. Each resistor of the resistor network is positioned so as to electrically connect a respective pair of adjacent electrical contacts. Each resistor in the resistor network comprises a resistance value that is different from resistance values of other resistors in the resistor network.

18 Claims, 4 Drawing Sheets

ROTARY SWITCH

CROSS REFERENCE TO RELATED APPLICATION AND CLAIM FOR PRIORITY

This application claims priority pursuant to 35 U.S.C. 119(a) of Indian Patent Application No. 202011002501, filed Jan. 20, 2020, which application is incorporated herein by reference in its entirety.

TECHNOLOGICAL FIELD

Example embodiments of the present invention relate generally to switch systems and, more particularly, to improved rotary switch configurations.

BACKGROUND

Medical equipment, computing devices, industrial controls, vehicle instrumentation, and related devices may rely on various sensors and switches during operation. For example, vehicles may leverage rotary switches to enable changes to the vehicle's operating state (e.g., various speeds) and/or to adjust various vehicle functions (e.g., head light intensity, wiper speed, etc.). However, the inventors have identified numerous deficiencies with these existing technologies in the field, the remedies for which are the subject of the embodiments described herein.

BRIEF SUMMARY

Apparatuses, systems, and associated methods of manufacturing are provided for switch systems. An example rotary switch may include a substrate and a plurality of electrical contacts supported by the substrate. The rotary switch may also include a resistor network including a plurality of resistors in electrical communication with the plurality of electrical contacts. The rotary switch may further include a commutator configured to move relative to the substrate along the plurality of electrical contacts. The commutator may be configured to electrically connect a pair of adjacent electrical contacts so as to modify an output voltage of the rotary switch corresponding to a position of the rotary switch.

In some embodiments, each resistor of the resistor network may be positioned so as to electrically connect a respective pair of adjacent electrical contacts. In such an embodiment, each resistor in the resistor network may define a resistance value that is different from resistance values of other resistors in the resistor network.

In some embodiments, the plurality of resistors may be connected in series between an input connection and an output connection.

In other embodiments, the commutator may be configured to electrically connect the pair of adjacent electrical contacts such that a resistor positioned in electrical communication between the pair of adjacent electrical contacts is bypassed.

In some further embodiments, the rotary switch may include a microcontroller operably coupled to the resistor network configured to determine the position of the rotary switch based on the output voltage.

In some embodiments, the plurality of electrical contacts may include a first set of electrical contacts and a second set of electrical contacts. In such an embodiment, the commutator may be configured to electrically connect pairs of adjacent electrical contacts of the first set, and a second commutator may be configured to electrically connect pairs of adjacent electrical contacts of the second set.

In any embodiment, the substrate may be formed as a disk. As such, the plurality of electrical contacts may be positioned along a peripheral edge of the disk and/or the substrate may define an opening positioned at the center of the disk.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Overview

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

As used herein, the phrases "in one embodiment," "according to one embodiment," "in some embodiments,"

and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the word "example" is used herein to mean "serving as an example, instance, or illustration." Any implementation described herein as "example" is not necessarily to be construed as preferred or advantageous over other implementations. Although described herein with reference to a rotary switch, the features, configurations, and devices of the present application may also be applicable to other switch devices, applications, and circuits.

Switch System

Figure 1:
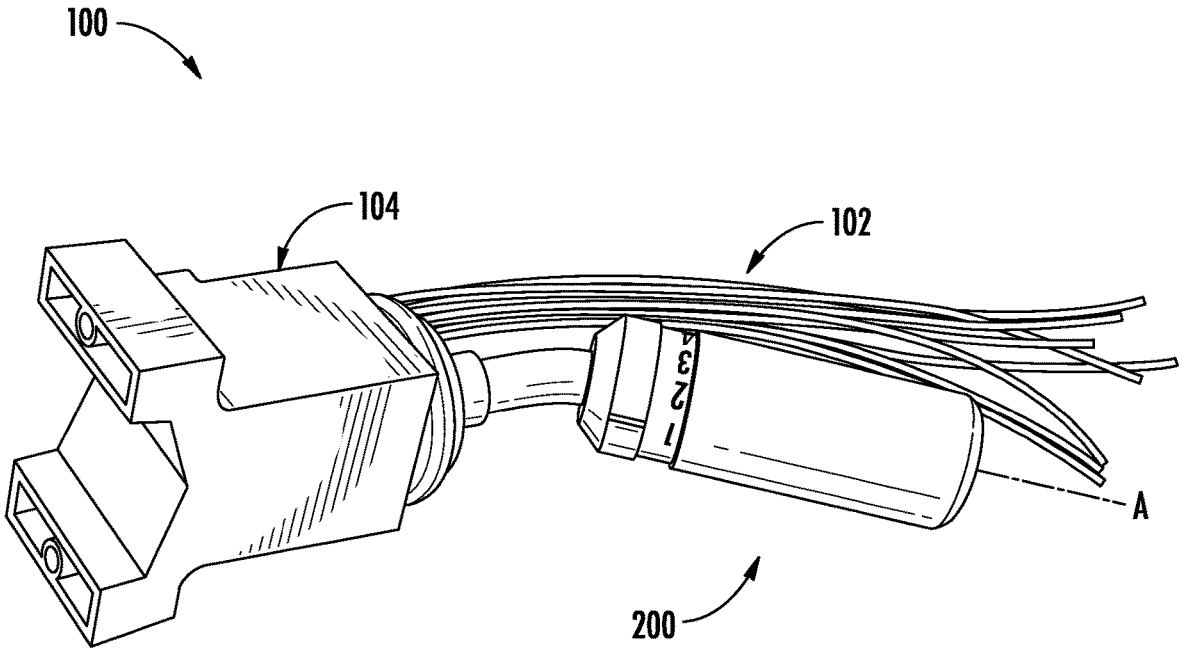
FIG. 1 is a perspective view of an example switch system for implementing some example embodiments described herein.

With reference to FIG. 1, an example switch system 100 is illustrated. As shown, the switch system 100 may include a rotary switch 200 enclosed or otherwise supported by housing elements 104. As shown, the switch system 100 may also include a plurality of electrical connections 102 (e.g., wires, wire harness, cables, etc.) configured to transmit electrical signals to the switch system 100 and/or receive electrical signals from the switch system 100. Furthermore, the electrical connections 102 may be configured to supply power to the switch system 100 via providing electrical communication between the switch system 100 and an external power source (e.g., battery, wired power connection, etc.).

As shown, the switch system 100 may include a rotary switch 200 as described hereafter that is configured to rotate about an axis A. A rotary switch may refer to a mechanical or electronic switch that is operated by rotation (e.g., user inputted rotation or otherwise) in that the rotary switch 200 may be rotated about axis A to various positions. As described above, some vehicles (e.g., tractors, golf carts, lawn mowers, or the like) may use rotary switches as a mechanism for altering an operating state or function of the vehicle. By way of example, a vehicle may use a rotary switch to allow for changing of the vehicle's operating state (e.g., various speeds) and/or to adjust various vehicle functions (e.g., head light intensity, wiper speed, etc.). Although described herein with reference to a rotary switch and associated switch systems 100 implemented in vehicle applications, the present disclosure contemplates that the rotary switch features and configurations described herein may also be applicable to medical equipment, computing devices, industrial controls, consumer products, appliances, and/or the like.

Conventional rotary switches, however, rely on common contacts to facilitate electrical communication within the switch. For example, conventional rotary switch designs use rows of electrical contacts and dedicated common contacts that serve as shorted electrical commons. In operation, a commutator may move within the switch such that the commutator contacts an electrical contact and an electrical common (e.g., dedicated neutral contact). In this way, the electrical common only operates to close the circuit for the electrical contact (e.g., via the commutator). Given that each electrical contact and associated position within the rotary switch requires an associated common contact, electrical commons occupy additional space within a rotary switch (e.g., of a printed circuit board (PCB)) without providing increased functionality. As such, the switch systems 100 of the present application may employ rotary switch 200 configurations with resistor networks that allow for a commutator to electrically connect a pair of adjacent electrical contacts so as to modify an output voltage of the rotary switch corresponding to a position of the rotary switch without relying on electrical commons. In doing so, the rotary switch 200 of the present application as described hereafter may operate to (1) reduce material costs associated with printed circuit board (PCB) assemblies due to reduced electrical components (e.g., no electrical commons), (2) to increase space on PCB assemblies for other components, and/or (3) to increase the reliability of the rotary switch by reducing the number of components required for operation.

Rotary Switch

Figure 2:
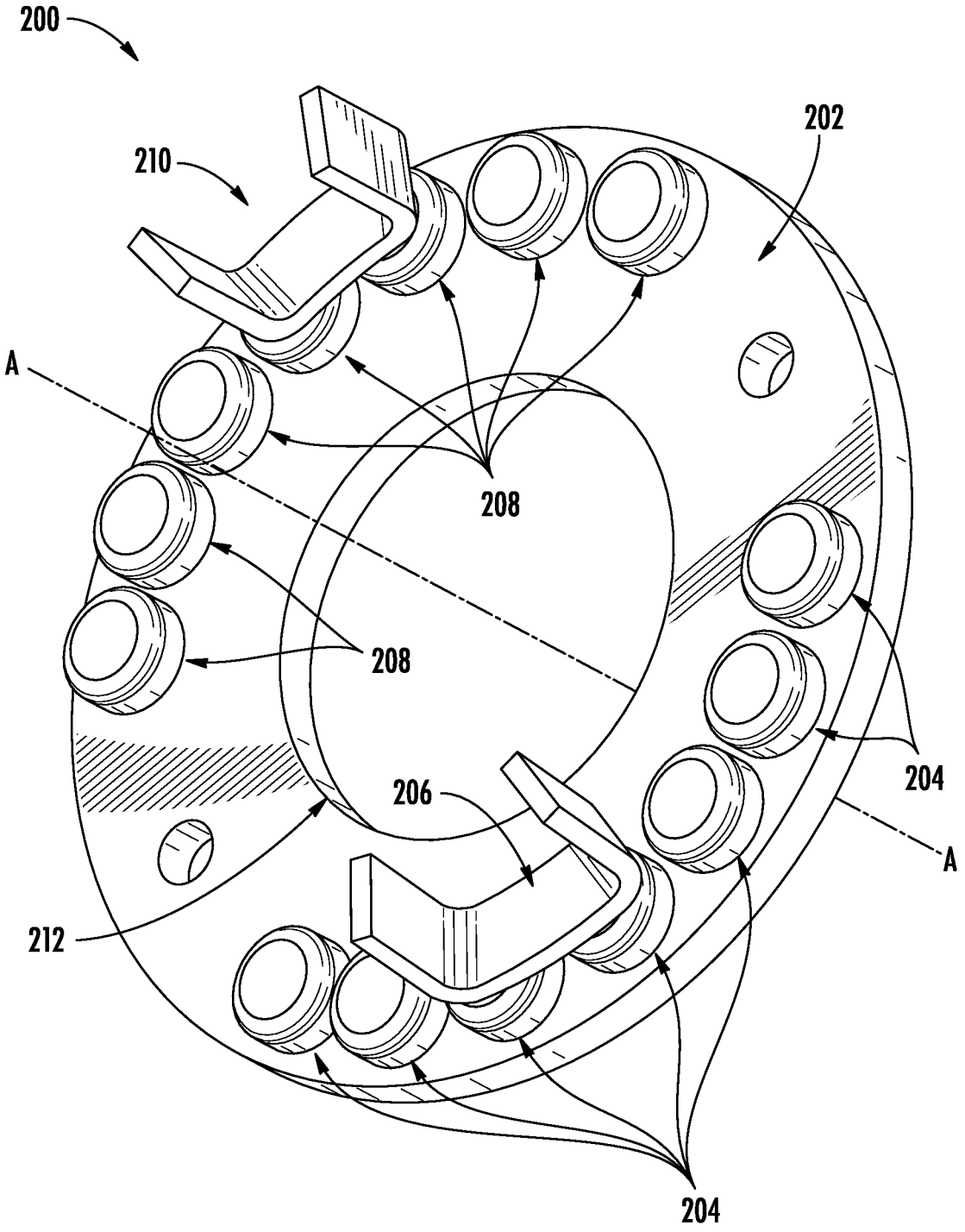
FIG. 2 is a perspective view of a rotary switch according to an example embodiment.

With reference to FIG. 2, an example rotary switch 200 is illustrated. As shown, the rotary switch 200 may include a substrate 202 supporting a plurality of electrical contacts 204, 208. The substrate 202 may comprise a printed circuit board (PCB) configured to provide electrical communication to various electrical components (e.g., electrical contacts 204, 208) supported thereon. As would be evident to one of ordinary skill in the art in light of the present disclosure, the substrate 202 may be formed via any process for creating substrates or PCBs (e.g., subtractive processes, additive processes, semi-additive processes, chemical etching, copper patterning, lamination, plating and coating, or the like). Furthermore, while the substrate 202 is illustrated herein as having a substantially circular or disk shape, the present disclosure contemplates that the substrate 202 may be dimensioned (e.g., sized and shaped) for use in any switch system 100 regardless of geometric constraints. As described above, the substrate 202 may be configured to support and facilitate electrical communication between various electrical components (e.g., electrical contacts 204, resistor network 205, etc.) connected thereto. As such, the plurality of electrical contacts 204 and one or more of the resistors (not shown) described hereafter may be secured to the substrate 202 (e.g., via an adhesive, soldering, etc.).

With continued reference to FIG. 2, the rotary switch 200 may also include a plurality of electrical contacts 204, 208. The electrical contacts 204, 208 may be formed of an electrically conductive material (e.g., gold alloy, silver alloy, conductive polymers, and/or other metals) such that, when contact is made with the electrical contact 204, 208, electric current may be passed via this contact. When the electrical contacts 204, 208 touch (e.g., via contact or the like) the commutator 206, 210, respectively, as described hereafter, electric current may pass via this contact. In some embodiments, the plurality of electrical contacts may be formed and/or positioned as a single set of electrical contacts (not shown) such that a single commutator may travel along the single set of electrical contacts. As illustrated in FIG. 2, however, in some embodiments, the plurality of electrical contacts may include a first set of electrical contacts 204 and a second set of electrical contacts 208 each with respective commutators 206, 210. As described hereafter, a first commutator 206 may be configured to electrically connect pairs of adjacent electrical contacts of the first set of electrical contacts 204. Similarly, a second commutator 210 may be configured to electrically connect pairs of adjacent electrical contacts of the second set of electrical contacts 208.

In some embodiments, the substrate 202 may be formed as a disk or equivalent shape with circular cross-section. In such an embodiment, the disk (e.g., plate or the like) may define an opening 212 located at the center of the disk. As described above, by providing a rotary switch 200 without centrally located electrical commons as found in conventional rotary switches, the rotary switch 200 described herein may be formed of a substrate 202 with less material. In other embodiments, the rotary switch 200 may be formed as a solid disk (e.g., a single piece of material) such that the substrate 202 includes additional space for supporting other electrical components. In embodiments in which the substrate 202 is formed as a disk, the plurality of electrical contacts may be positioned along a peripheral edge of the disk so as to further provide increased space on the substrate 202 or allow for further substrate 202 material to be removed.

Figure 3:
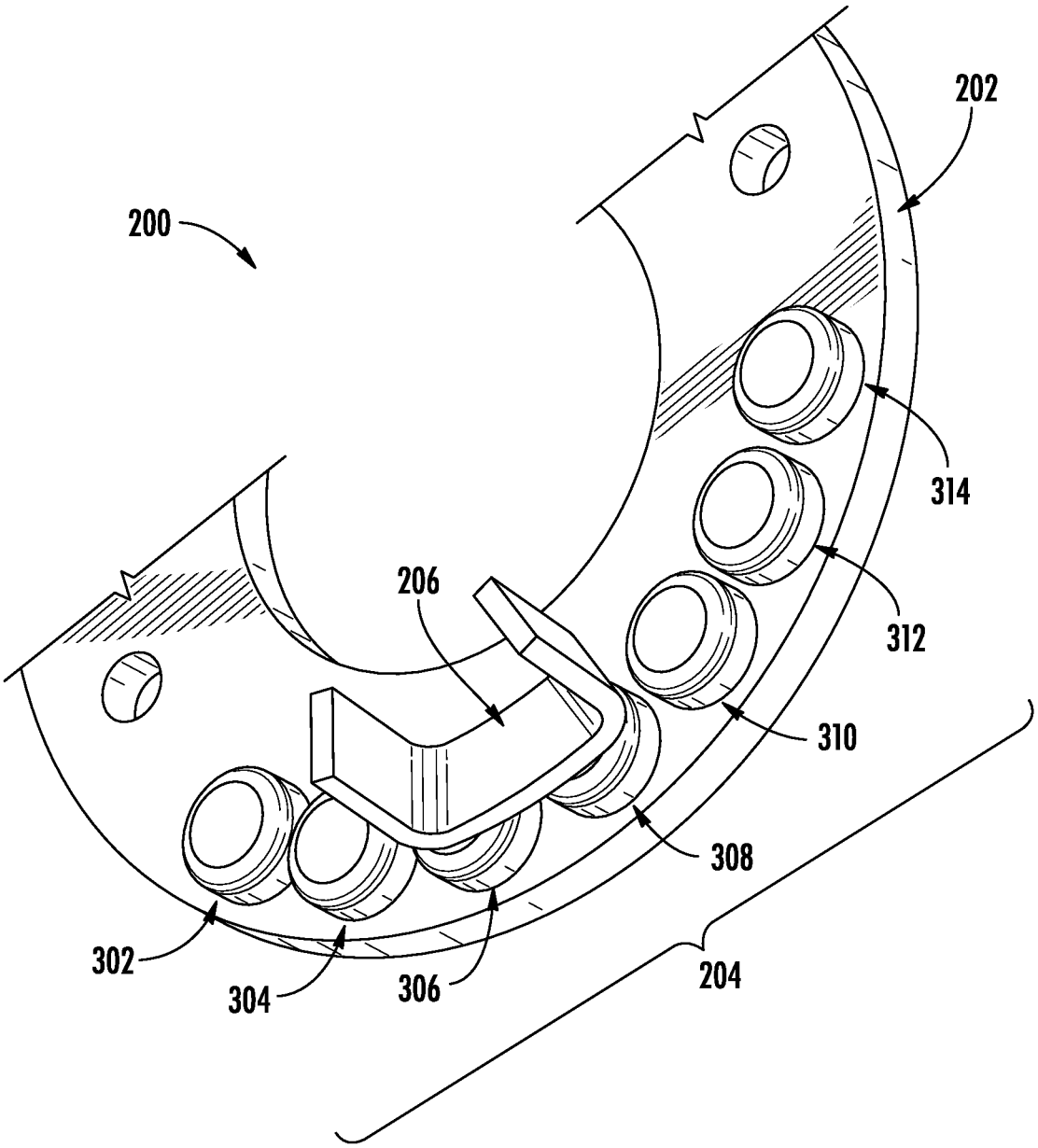
FIG. 3 is a portion of the rotary switch of FIG. 2 according to an example embodiment.
Figure 4:
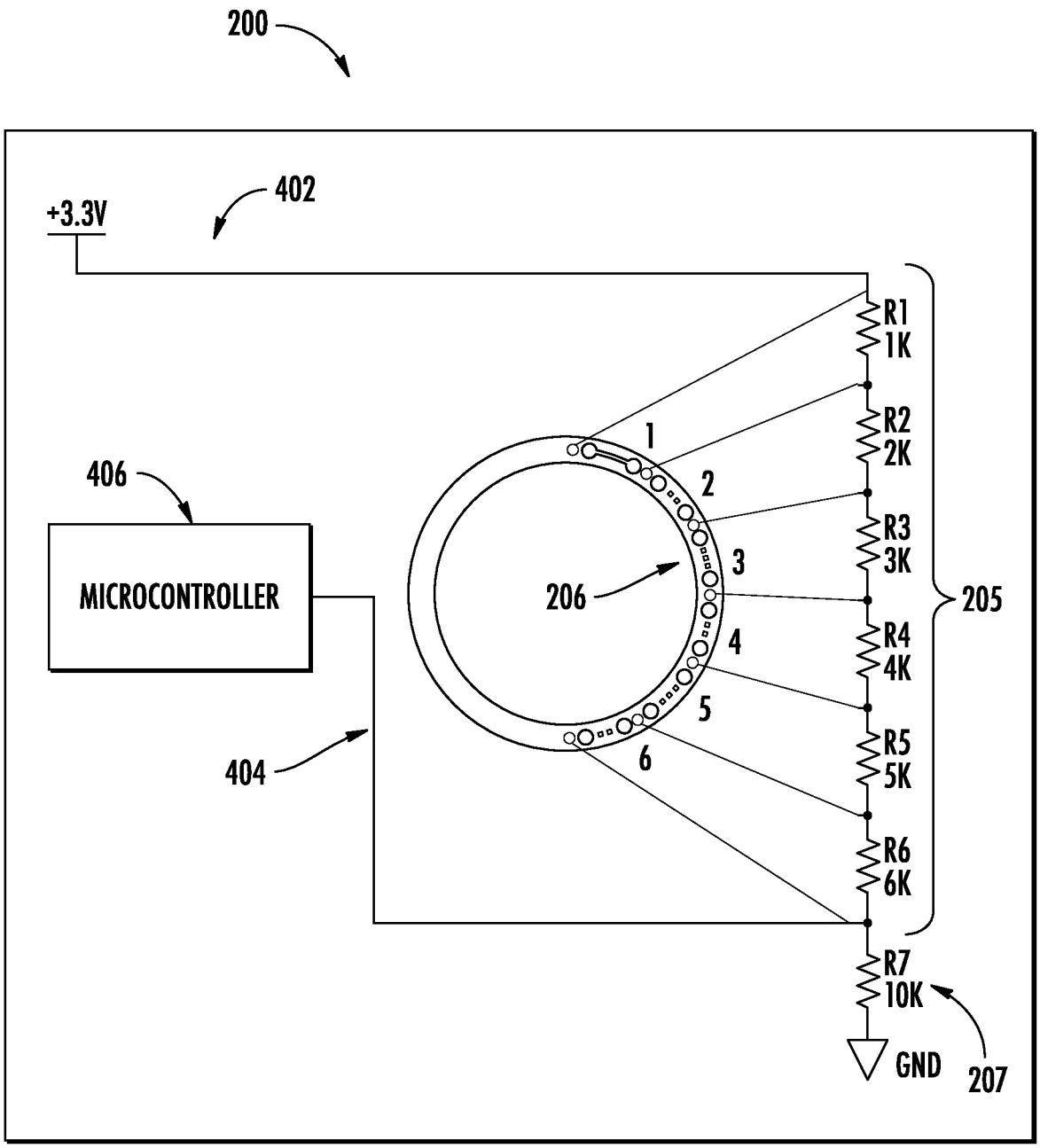
FIG. 4 is an example circuit diagram of the rotary switch of FIG. 2 including a microcontroller according to an example embodiment.

With continued reference to FIG. 2, the rotary switch 200 may include a resistor network (e.g., resistor network 205 in FIG. 4) that is formed of a plurality of resistors (not shown) in electrical communication with the plurality of electrical contacts 204, 208. As would be evident to one of ordinary skill in the art in light of the present disclosure, a resistor may refer to a passive electrical component that creates electrical resistance as a circuit element. The plurality of resistors (not shown) may be fixed resistors (e.g., lead arrangement, carbon pile, carbon film, thick or thin film, metal fil, wire wound, foil resistor, etc.) or variable resistors (e.g., resistance decade boxes, potentiometers, or the like). As illustrated in FIG. 4 hereafter, the resistor network is configured to provide electrical communication between each of the electrical contacts within a set of electrical contacts 204, 208. By way of example, each resistor of the resistor network (not shown) may be positioned so as to electrically connect a respective pair of adjacent electrical contacts 204. For example, each electrical contact 204, as described hereafter with reference to FIG. 3, may be connected to an adjacent electrical contact 204 via a resistor of the resistor network (not shown). Said differently, the plurality of resistors that form the resistor network (not shown) may be connected in series, each positioned between electrical contacts 204. As described hereafter with reference to FIG. 4, each resistor in the resistor network (not shown) may include a resistance value that is different from resistance values of other resistors in the resistor network.

Reference hereafter is made to the first set of electrical contacts 204 and associated commutator 206; however, operation of the second commutator 210 and associated second set of electrical contacts 208 may operate substantially the same as the electrical contacts 204 and first commutator 206. With reference to FIG. 3, the rotary switch 200 may further include a commutator 206 configured to move relative to the substrate 202 along the plurality of electrical contacts 204. As shown, the commutator 206 is configured to electrically connect a pair of adjacent electrical contacts, for example a third contact 306 and a fourth contact 308. As would be evident to one of ordinary skill in the art in light of the present disclosure, the plurality of electrical contacts 204 may be supported by the substrate 202 such that positions at which the location of the commutator 206 contacts adjacent electrical contacts 204 may be defined. In FIG. 3, for example, the substrate may support a first electrical contact 302, a second electrical contact 304, a third electrical contact 306, a fourth electrical contact 308, a fifth electrical contact 310, a sixth electrical contact 312, and a seventh electrical contact 314. As such, a first position may refer to the position at which the commutator 206 contacts the first electrical contact 302 and the second electrical contact 304, a second position may refer to the position at which the commutator 206 contacts the second electrical contact 304 and the third electrical contact 306, etc.

As described hereafter with reference to FIG. 4, the resistor network (e.g., resistor network 205 in FIG. 4) may be configured to electrically connect each of the electrical contacts 204 such that a resistor having a unique resistance value is positioned between adjacent electrical contacts 204. Said differently, each position (e.g., position of the commutator 206) may be associated with a resistor that is bypassed by the commutator 206 such that the commutator 206 modifies an output voltage of the rotary switch 200 corresponding to a position of the rotary switch 200. As shown in FIG. 3, the commutator 206 is located in the third position between the third electrical contact 306 and the fourth electrical contact 308. As such, the resistor of the resistor network (not shown) associated with the third position is bypassed. Said differently, the commutator may operate as the path of least resistance for electric current supplied to the rotary switch 200 (i.e., the resistance value of the commutator 206 is less than the resistance value of each resistor of the resistor network). In this way, the commutator 206 may reduce the resistance of the electric current in the rotary switch 200 by an amount equivalent to the total resistance value of each resistor in the resistor network less the resistance value for the resistor located at the position of the commutator 206. Given that Ohm's law states that the current through a conductor between two points is directly proportional to the voltage across the two points (V=IR), the voltage output by the rotary switch 200 may be modified by the change in resistance.

With reference to FIG. 4, an example circuit diagram of the rotary switch 200 and associated resistor network 205 is illustrated. As shown, the resistor network 205 may include a plurality of resistors connected in series between an input connection 402 and an output connection 404. The resistor network 205 may include a first resistor R1 having a first resistance value and positioned between the first electrical contact 302 and the second electrical contact 304. The resistor network 205 may include a second resistor R2 having a second resistance value and positioned between the second electrical contact 304 and the third electrical contact 306. The resistor network 205 may include a third resistor R3 having a third resistance value and positioned between the third electrical contact 306 and the fourth electrical contact 308. The resistor network 205 may include a fourth resistor R4 having a fourth resistance value and positioned between the fourth electrical contact 308 and the fifth electrical contact 310. The resistor network 205 may include a fifth resistor R5 having a fifth resistance value and positioned between the fifth electrical contact 310 and the sixth electrical contact 312. The resistor network 205 may include a sixth resistor R6 having a sixth resistance value and positioned between the sixth electrical contact 312 and the seventh electrical contact 314. In such an example embodiment, the resistance values for each of R1, R2, R3, R4, R5, and R6 are unique (e.g., different from one another).

In operation, the input connection 402 may receive an electric voltage having a defined voltage (e.g., 3.3 V). The output connection 404 may be connected to a ground resistor 207 so as to complete an electric circuit. In this example as illustrated in FIG. 4, the rotary switch 200 includes a single ground resistor 207 (e.g., resistor R7). The resistor network 205 and ground resistor 207 form a voltage divider network. In an instance in which the commutator 206 fails to contact any adjacent pairs of electrical contacts, the resistance value for the resistor network is equivalent to the sum of each resistor (e.g., the sum of resistances of R1, R2, R3, R4, R5, and R6). As the commutator 206 moves along the plurality of electrical contacts 204, however, the commutator 206 may electrically connect a pair of adjacent electrical contacts 204. In doing so, the resistance value between the input connection 402 and the output connect 404 is reduced by the resistance value of the resistor located between the pair of adjacent electrical contacts 204.

By way of a particular example, in an instance in which the resistor network 205 includes resistors R1, R2, R3, R4, R5, and R6 having resistance values as illustrated in Table 1 below, the total resistance for the resistor network 205 prior to electrical connection by the commutator 206 is 21 kΩ. In an instance in which the commutator 206 is located at position three providing electrical connection between the third electrical contact 306 and the fourth electrical contact 308, the total resistance for the resistor network 205 is reduced by the resistance value of the resistor between the third electrical contact 306 and the fourth electrical contact 308 (e.g., 3 kΩ). Said differently, the electric current received by rotary switch 200 bypasses the resistor located at position 3. As shown in Table 1, the resistance value between the input connection 402 and the output connection 404 is therefore 18 kΩ. By way of a further example, in an instance in which the input connection 402 receives 3.3 V, the output voltage of at the output connection 402 may be modified to approximately 1.179 V. Although described herein with reference to a rotary switch 200 having seven (7) electrical contacts 204 and, by association, a resistor network including six (6) resistors, the present disclosure contemplates that the rotary switch 200 may include any number of electrical contacts 204 and associated resistors based upon the intended application of the rotary switch 200.

TABLE 1

Example voltage output based on commutator position.

| Commutator Position | Resistor Resistance Value | Resistance value between Input and Output | Voltage at Output |
|---|---|---|---|
| 1 | 1 kΩ | 20 kΩ | 1.100 V |
| 2 | 2 kΩ | 19 kΩ | 1.138 V |
| 3 | 3 kΩ | 18 kΩ | 1.179 V |
| 4 | 4 kΩ | 17 kΩ | 1.222 V |
| 5 | 5 kΩ | 16 kΩ | 1.269 V |
| 6 | 6 kΩ | 15 kΩ | 1.320 V |

With continued reference to FIG. 4, in some embodiments, the rotary switch 200 may include a microcontroller 406 configured to receive a voltage output from the output connection 404 and determine the rotational position (e.g., degrees, radians, relative positioning, etc.) of the rotary switch 200. In order to determine the rotational position, the microcontroller 406 may be embodied in any number of different ways and may, for example, include one or more processing devices configured to perform independently. By way of example, the microcontroller may be configured to execute instructions stored in a memory or otherwise accessible to one or more processors of the microcontroller 406. Alternatively or additionally, the microcontroller 406 may be configured to execute hard-coded functionality. As such, whether configured by hardware or by a combination of hardware with software, the microcontroller 406 may represent an entity (e.g., physically embodied in circuitry) capable of performing operations according to an embodiment of the present invention while configured accordingly. In some embodiments, the rotary switch 200 may further include a level shifted instrumentation amplifier or equivalent circuitry, housed by the rotary switch 200, the microcontroller 406, or the like, to facilitate conversion of the output voltage from the rotary switch 200 to a corresponding position of the rotary switch 200. In some embodiments, the rotary switch 200 may comprise the microcontroller and amplifier circuitry, while in other embodiments, the microcontroller 406 and/or the level shifted instrumentation amplifier may be housed separate from the rotary switch 200.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A rotary switch comprising:

a substrate;

a plurality of electrical contacts supported by the substrate;

a resistor network comprising a plurality of resistors in electrical communication with the plurality of electrical contacts; and a commutator configured to move relative to the substrate along the plurality of electrical contacts, wherein the commutator is configured to electrically connect a pair of adjacent electrical contacts so as to modify an output voltage of the rotary switch corresponding to a position of the rotary switch, wherein the plurality of electrical contacts further comprise a first set of electrical contacts and a second set of electrical contacts, wherein the commutator is configured to electrically connect pairs of adjacent electrical contacts of the first set, and a second commutator is configured to electrically connect pairs of adjacent electrical contacts of the second set.

2. The rotary switch according to claim 1, wherein each resistor of the resistor network is positioned so as to electrically connect a respective pair of adjacent electrical contacts.

3. The rotary switch according to claim 2, wherein each resistor in the resistor network comprises a resistance value that is different from resistance values of other resistors in the resistor network.

4. The rotary switch according to claim 1, wherein the plurality of resistors are connected in series between an input connection and an output connection.

5. The rotary switch according to claim 1, wherein the commutator is configured to electrically connect the pair of adjacent electrical contacts such that a resistor positioned in electrical communication between the pair of adjacent electrical contacts is bypassed.

6. The rotary switch according to claim 1, further comprising a microcontroller operably coupled to the resistor network configured to determine the position of the rotary switch based on the output voltage.

7. The rotary switch according to claim 1, wherein the substrate is formed as a disk.

8. The rotary switch according to claim 7, wherein the plurality of electrical contacts are positioned along a peripheral edge of the disk.

9. The rotary switch according to claim 7, wherein the substrate further defines an opening positioned at the center of the disk.

10. A method of manufacturing a rotary switch, the method comprising:

providing a substrate;

supporting a plurality of electrical contacts on the substrate;

providing a resistor network comprising a plurality of resistors in electrical communication with the plurality of electrical contacts; and providing a commutator configured to move relative to the substrate along the plurality of electrical contacts, wherein the commutator is configured to electrically connect a pair of adjacent electrical contacts so as to modify an output voltage of the rotary switch corresponding to a position of the rotary switch, wherein the plurality of electrical contacts comprise a first set of electrical contacts and a second set of electrical contacts, wherein the commutator is configured to electrically connect pairs of adjacent electrical contacts of the first set, and a second commutator is configured to electrically connect pairs of adjacent electrical contacts of the second set.

11. The method according to claim 10, further comprising positioning each resistor of the resistor network such that each resistor is electrically connected to a respective pair of adjacent electrical contacts.

12. The method according to claim 11, wherein each resistor in the resistor network comprises a resistance value that is different from resistance values of other resistors in the resistor network.

13. The method according to claim 11, wherein the plurality of resistors are connected in series between an input connection and an output connection.

14. The method according to claim 10, wherein the commutator is configured to electrically connect the pair of adjacent electrical contacts such that a resistor positioned in electrical communication between the pair of adjacent electrical contacts is bypassed.

15. The method according to claim 10, further comprising providing a microcontroller operably coupled to the resistor network configured to determine the position of the rotary switch based on the output voltage.

16. The method according to claim 10, wherein the substrate is formed as a disk.

17. The method according to claim 16, wherein the plurality of electrical contacts are positioned along a peripheral edge of the disk.

18. The method according to claim 16, further comprising defining an opening in the substrate positioned at the center of the disk.

* * * * *